US007614814B2

(12) United States Patent
Lee et al.

(10) Patent No.: US 7,614,814 B2
(45) Date of Patent: Nov. 10, 2009

(54) ENHANCED FLUID DISPENSER CONTAINER FITMENT

(75) Inventors: Jae Woo Lee, Flower Mound, TX (US); Yoon Seong On, Flower Mound, TX (US); Doug Williams, White Plains, NY (US)

(73) Assignee: Bao Sheng Corporation (KR)

( * ) Notice: Subject to any disclaimer, the term of this patent is extended or adjusted under 35 U.S.C. 154(b) by 48 days.

(21) Appl. No.: 11/515,594

(22) Filed: Sep. 5, 2006

(65) Prior Publication Data

US 2007/0292193 A1 Dec. 20, 2007

Related U.S. Application Data

(60) Division of application No. 11/128,734, filed on May 13, 2005, now Pat. No. 7,293,931, which is a continuation-in-part of application No. 11/101,336, filed on Apr. 7, 2005, now abandoned.

(60) Provisional application No. 60/570,783, filed on May 13, 2004.

(51) Int. Cl.
*A46B 17/04* (2006.01)

(52) U.S. Cl. ..... 401/269; 401/278; 401/280; 401/282

(58) Field of Classification Search ..... 401/202, 401/213, 262, 263, 269, 270, 272, 276, 278, 401/280, 282, 286
See application file for complete search history.

(56) References Cited

U.S. PATENT DOCUMENTS

| | | | |
|---|---|---|---|
| 427,444 | A | 5/1890 | Smith |
| 1,220,875 | A | 3/1917 | Moore |
| 2,104,638 | A | 1/1938 | Cuthbert |
| 2,442,746 | A | 6/1948 | Anderson et al |
| 2,956,547 | A | 10/1960 | Hovey, Jr. |
| 3,095,175 | A | 6/1963 | Iketanl |
| 3,106,742 | A | 10/1963 | Schultz et al. |
| 3,356,441 | A | 12/1967 | Schwartzman |
| 3,400,997 | A | 9/1968 | Schwartzman |
| 3,685,786 | A | 8/1972 | Woodson |
| 4,002,182 | A | 1/1977 | Michel |
| 4,040,753 | A | 8/1977 | Griffith |
| 4,368,746 | A | 1/1983 | Spatz |

(Continued)

FOREIGN PATENT DOCUMENTS

| | | |
|---|---|---|
| JP | 11113628 | 7/1999 |

(Continued)

*Primary Examiner*—Tuan N. Nguyen
(74) *Attorney, Agent, or Firm*—Bracewell & Giuliani LLP

(57) ABSTRACT

A fluid dispensing assembly having a container body for storing a cosmetic or other fluid material, the body having a dispensing opening, an applicator protruding from the dispensing opening for receiving material from the container and applying the material, a cap matingly engagable with the container body and a fitment in the dispenser opening matingly engagable with and moveable with respect to the container body between an open position and a closed position in response to engagement with the cap, the fitment having an aperture formed therein for allowing material to exit the container body in the open position disengaged from the cap, and a case mounted thereto, the aperture at least partially closing when the cap engages the case and moves the fitment with respect to the container body.

13 Claims, 7 Drawing Sheets

U.S. PATENT DOCUMENTS 5,529,278 A * 6/1996 Weldon et al. ..... 251/4
5,591,137 A * 1/1997 Stevens ..... 604/296
5,810,495 A 9/1998 McCauley et al.
5,904,433 A 5/1999 Kay
7,293,931 B2 * 11/2007 Lee et al. ..... 401/269
2004/0047674 A1 3/2004 Geardino et al.
2005/0276655 A1 * 12/2005 Tajima ..... 401/278

FOREIGN PATENT DOCUMENTS

WO WO 88/04148 6/1988
WO WO 2005/053457 6/2005

* cited by examiner

ENHANCED FLUID DISPENSER CONTAINER FITMENT

RELATED APPLICATIONS

This application is a divisional of application Ser. No. 11/128,734, filed May 13, 2005, which now U.S. Pat. No. 7,293,931 is a continuation-in-part of U.S. patent application Ser. No. 11/101,336, filed Apr. 7, 2005, now abandoned which claims the benefit of U.S. Provisional Patent Application Ser. No. 60/570,783 filed May 13, 2004.

FIELD OF THE INVENTION

This invention relates in general to containers for fluids, for example cosmetics, and in particular to a fitment for preventing leakage of fluids from such containers.

DESCRIPTION OF THE PRIOR ART

Liquid makeup and other viscous cosmetics are often stored in specialized cosmetics containers. These containers typically include a reservoir for storing the cosmetics and an applicator, for example a brush, for allowing a user to apply the cosmetics. In certain containers, the applicator is affixed to the cap of the container, whereby the user grasps the cap, dips the applicator into the reservoir until a sufficient amount of makeup is on the applicator, and then removes the applicator and applies the makeup. Alternatively, the applicator can be affixed to the container body itself, whereby, for example, the user squeezes the container to force makeup out of the reservoir and directly into or onto the applicator.

In the case where the applicator is affixed directly to the container body, it is not uncommon for leakage to occur at or near the location where the makeup passes from the storage reservoir into the applicator. This leakage can occur either during use of the device, when the cap has been removed from the container, or when the device is not in use and the cap is affixed to the container. When the cap is affixed to the container, leaking makeup can accumulate under the cap, such that once the cap is removed from the container, the accumulated makeup will spill out.

Various types of cosmetics containers have been proposed to prevent or reduce this leakage. Certain of these containers utilized both a cap and a sealing mechanism, for example, a stopper, to prevent leakage. The sealing mechanism was designed to prevent potential leakage, and any makeup that did leak past the sealing mechanism was subsequently caught in the cap. However, a user had to perform multiple steps in order to access the makeup in these containers. For example, the user had to first remove the cap, and then disengage the stopper, in order to initiate flow of makeup from the device. Multiple steps were also needed to close and store the container, in that the user had to first engage the stopper, and then place the cap on the container, in order to provide maximum leakage protection when the device was not in use. Further, the sealing mechanisms were not effective to prevent leakage at the location between the storage reservoir and the applicator, and the sealing mechanisms were often easily removable from the container, which increased the likelihood of leakage.

Prior to the development of the present invention, there has been no fluid dispenser assembly for use in storing and dispensing fluids, including makeup and other cosmetics, which: effectively prevents leakage of fluids such as makeup from a cosmetics container; provides an improved seal at the location between the storage reservoir and the applicator of a fluid container; utilizes a sealing mechanism which is not easily removable from the fluid container; allows a user to remove the cap from a fluid container and access makeup from the reservoir in a single step; and allows a user to place the cap on a fluid container and restrict access to fluid from the fluid storage reservoir in a single step.

SUMMARY OF THE INVENTION

Accordingly, the present invention provides a dispensing assembly for fluids such as cosmetics or other liquid materials. In one embodiment, the assembly includes a container body for storing a liquid material, the body having a dispensing opening with an axis, a dispenser in the dispensing opening matingly engagable with and axially moveable with respect to the container body between an open position and a closed position, the dispenser having an aperture formed therein for allowing liquid material to exit the dispensing opening of the container body while in the open position, the aperture at least partially closing the dispensing opening when the dispenser is in the closed position, a shoulder formed on the dispenser, a cap matingly engagable with the container body, the cap having a shoulder that engages the shoulder of the dispenser and moves the dispenser to the closed position when closing the cap on the container body and an applicator mounted to and protruding from the dispenser for receiving liquid material from the aperture in the dispenser and applying the liquid material, the applicator being enclosed by the cap while the cap is closed on the container.

An additional feature of an embodiment of the invention is that an insert is mounted in the dispensing opening of the container. The insert preferably has a base with an aperture in communication with the dispensing opening, the dispenser being carried by the insert for relative movement between the open and closed positions. Further, the insert may have a hollow interior, and the dispenser is at least partially disposed within the hollow interior of the insert. In an embodiment, the dispensing opening of the container body has a downward facing shoulder surface and the shoulder on the dispenser contacts the downward facing shoulder surface while in the open position and disengages while in the closed position.

The assembly of an embodiment of the present invention can also preferably have a seal located on the base of the insert with an aperture therein to allow flow while in the open position and wherein the seal is formed of an elastomer material so that downward force of the base of the dispenser while the dispenser is in a closed position deforms the seal and causes it to close. The base of the insert can preferably be formed of silicon. The assembly can further include a spring disposed between the insert and the dispenser to bias the dispenser away from the insert. Preferably, the aperture in the base of the insert has an enlarged portion, and the dispenser has an extension portion that sealingly engages the enlarged portion, the extension portion containing an aperture that registers with the aperture in the insert while the dispenser is in the open position, the extension portion blocking the aperture in the insert while in the closed position. In one embodiment, a case is formed on the insert and extends from the shoulder on the dispenser. Further, the shoulder on the dispenser can comprise a radially extending flange.

In another embodiment, the present invention provides a fluid dispenser assembly including a container body for storing a liquid material, the body having a dispensing opening with an axis, a dispenser in the dispensing opening matingly engagable with and axially moveable with respect to the container body between an open position and a closed position, the dispenser having an aperture formed therein for allowing liquid material to exit the dispensing opening of the container body while in the open position, the aperture at least partially closing the dispensing opening when the dispenser is in the closed position, an insert mounted in the dispensing opening of the container, the insert having a hollow interior and a base disposed therein, the base having an aperture in communication with the dispensing opening, the dispenser being at least partially disposed within the hollow interior of the insert and carried by the insert for relative movement between the open and closed positions, a seal located on the base of the insert and having an aperture formed therein to allow flow from the aperture while in the open position, the seal being formed of an elastomer material so that downward force of the base of the dispenser while the dispenser is in a closed position deforms the seal and causes it to close, a shoulder formed on the dispenser, a cap matingly engagable with the container body, the cap having a shoulder that engages the shoulder of the dispenser and moves the dispenser to the closed position when closing the cap on the container body and an applicator mounted to and protruding from the dispenser for receiving liquid material from the aperture in the dispenser and applying the liquid material, the applicator being enclosed by the cap while the cap is closed on the container.

An additional feature of certain embodiments of the invention is that the applicator comprises a cylindrical member with an upper end having a plurality of apertures formed therein. The applicator can preferably have at least one tube contained therein for delivering liquid material. The assembly can have a retaining shoulder on the insert and a rib on the dispenser, and the retaining shoulder preferably engages the rib in the open position, and the retaining shoulder disengages from the rib in the closed position.

In another embodiment, the present invention provides a fluid dispenser assembly having a container body for storing a liquid material, the body having a dispensing opening with an axis, a dispenser in the dispensing opening matingly engagable with and axially moveable with respect to the container body between an open position and a closed position, the dispenser having an aperture formed therein for allowing liquid material to exit the dispensing opening of the container body while in the open position, the aperture at least partially closing the dispensing opening when the dispenser is in the closed position, an insert mounted in the dispensing opening of the container, the insert having a hollow interior and a base disposed therein, the base having an aperture in communication with the dispensing opening, the dispenser being carried by the insert for relative movement between the open and closed positions, and whereby the aperture in the base of the insert has an enlarged portion, and the dispenser has an extension portion that sealingly engages the enlarged portion, the extension portion containing an aperture that registers with the aperture in the insert while the dispenser is in the open position, the extension portion blocking the aperture in the insert while in the closed position, a spring disposed between the insert and the dispenser to bias the dispenser away from the insert, a shoulder formed on the dispenser, a cap matingly engagable with the container body, the cap having a shoulder that engages the shoulder of the dispenser and moves the dispenser to the closed position when closing the cap on the container body and an applicator mounted to and protruding from the dispenser for receiving liquid material from the aperture in the dispenser and applying the liquid material, the applicator being enclosed by the cap while the cap is closed on the container. An additional feature is that the spring is a coiled member that surrounds the extension portion of the dispenser.

BRIEF DESCRIPTION OF THE DRAWINGS

The various aspects of the invention will now be described by way of example only with reference to the accompanying drawings, in which.

DETAILED DESCRIPTION

Figure 1:
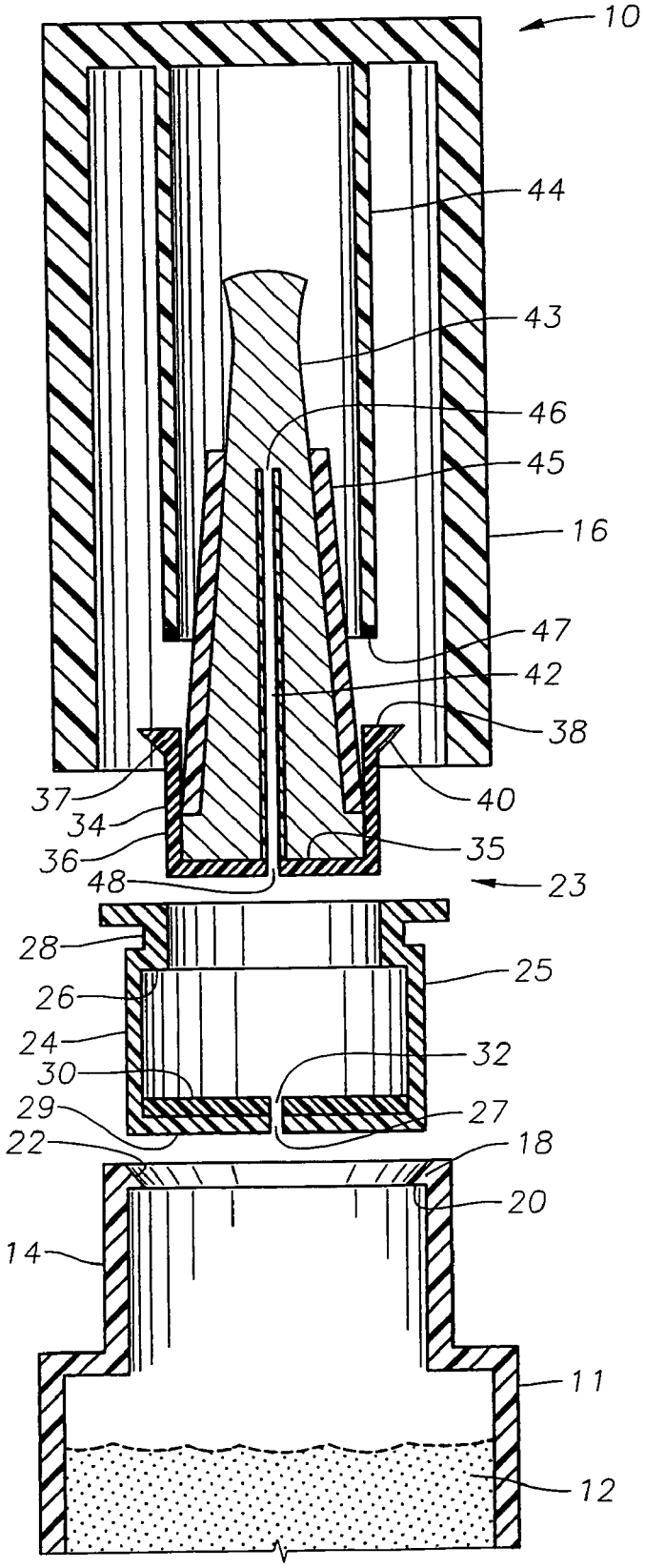
FIG. 1 is a front cross-section view of the components of a fluid applicator assembly including a cap in accordance with an embodiment of this invention.

FIG. 1 shows the components of a fluid dispenser assembly 10 according to an embodiment of the present invention. The assembly 10 is preferably used for dispensing cosmetics in the form of a liquid or viscous material. Assembly 10 includes a vessel or container body 11 which stores the cosmetic or other material 12. Neck 14 extends upward from vessel 11 and typically has a smaller diameter than vessel 11. Neck 14 has a hollow interior. In one embodiment, neck 14 has conventional external screw threads (not shown) so that a cap 16 with corresponding internal screw threads (not shown) can be attached to vessel 11. In alternative embodiments, a friction or snap-on fit between cap 16 and neck 14 may be employed. Near its upper end, neck 14 has a band 18 that protrudes inward and has a flat downward facing shoulder surface 20 and a conical upward facing shoulder surface 22. In a preferred embodiment, downward facing shoulder surface 20 is perpendicular to the axis of neck 14, and upward facing shoulder surface 22 is at an angle of 45 degrees relative to the axis of neck 14.

Assembly 10 further includes a fitment 23 having an insert 24 with a seal 30 disposed therein and a dispenser 34. Preferably, insert 24 has a cylindrical outer chamber 25, a hollow annular interior and a flat bottom or base 29 having an aperture 27. Seal 30 is located on and is co-extensive with base 29. Seal 30 has a central aperture 32. Hole 32 is approximately 1.0 mm in diameter, or about the same diameter as a standard sewing needle. Seal 30 is preferably formed of a soft elastic material, for example silicone or rubber. In one embodiment, insert 24 is formed of a plastic or other similar material.

Insert 24 has a downward facing shoulder surface 26 disposed within the interior wall of its outer chamber 25. Insert 24 has an outer diameter that is smaller than the interior diameter of neck 14 so that insert 24 may be fitted within neck 14. The conical upward facing shoulder surface 22 of band 18 on neck 14 allows insert 24 to slide into neck 14. Insert 24 has an outward facing groove 28 formed in the surface of its outer chamber 25. Groove 28 is sized so that band 18 of neck 14 will fit within groove 28 when insert 24 is disposed within neck 14.

Dispenser 34 preferably has a base 35, a cylindrical outer chamber 36 and a hollow interior. In one embodiment, dispenser 34 is formed of a plastic or other similar material. Dispenser 34 has a flanged band 37 disposed at the upper portion of chamber 36 that protrudes outward and has a flat upward facing shoulder surface 38 and a conical downward facing shoulder surface 40. In a preferred embodiment, upward facing shoulder surface 38 is perpendicular to chamber 36, and downward facing surface 40 forms a 45-degree angle. Dispenser 34 has an outer diameter that is smaller than the interior diameter of insert 24 so that dispenser 34 may fit within insert 24. The sloped downward facing shoulder surface 40 of band 37 allows dispenser 34 to slide into insert 24.

In one embodiment, a dispensing tube 42 is fitted within, and extends upward from, base 35 of dispenser 34. Tube 42 is preferably constructed of a plastic or other similar flexible material. Applicator 43, for example a brush, is fitted within and extends upward from dispenser 34 and surrounds tube 42. In one embodiment, applicator 43 is at least partially surrounded by a case or sheath 45. Sheath 45 is preferably constructed of clear plastic or some other similar material, and keeps applicator 43 in place. Sheath 45 is press-fitted or otherwise secured in chamber 36. Cosmetic is able to flow into tube 42 from hole 32 in seal 30 and out of at least one opening 46 in tube 42. In another embodiment, the cosmetic flows directly from an aperture 48 in dispenser 34 without the use of a dispensing tube.

Applicator 43 may also function to distribute or disseminate a liquid material 12 from the assembly 10. The liquid material 12 in the container 11 can be cosmetics, or alternately, can be any other liquid or viscous fluid material that is distributed, disseminated or applied in accordance with the present invention.

Applicator cap 16 is preferably cylindrical and has an annular interior. Cap 16 has at least one engagement member 44 that extends downward within the interior of cap 16 or alternatively, forms a shoulder in the interior of cap 16 as shown in FIGS. 8-13. In this embodiment, the member 44 extends concentrically from the top of cap 16 and is a cylindrical wall with a hollow annular interior that fits over and covers brush 43 and tube 42 when cap 16 is disposed upon vessel 11. An annular space exists between engagement member 44 and cap 16. Alternatively, engagement member 44 may be a plurality of arms that extend downward within the interior of cap 16. In certain embodiments, engagement member 44 may have a friction reducing element 47, for example padding, at its lower end for contact with surface 38 of dispenser 34.

Figure 3:
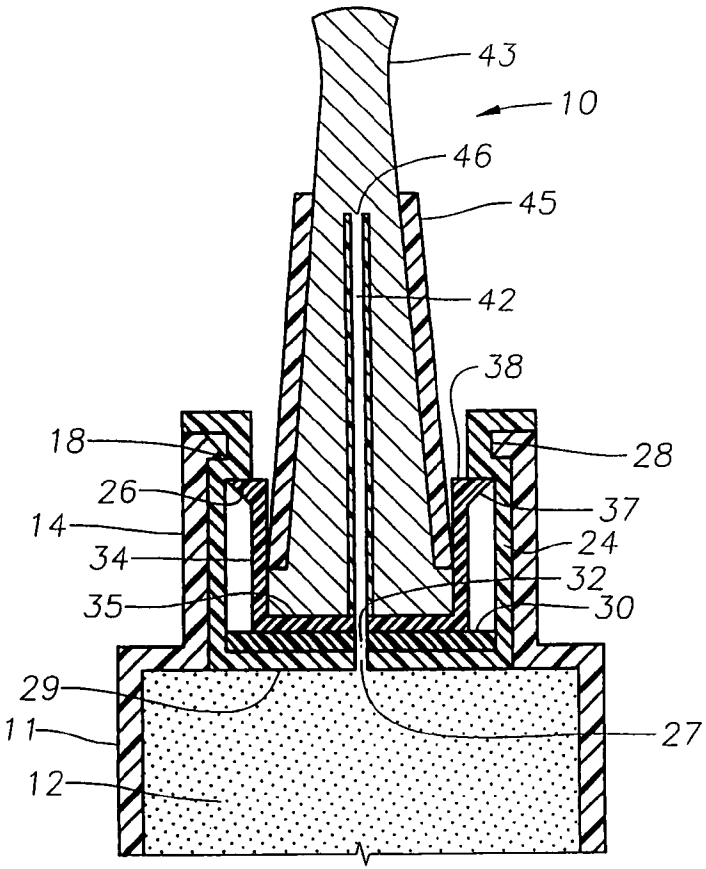
FIG. 3 is a front cross-section view of the assembly with its cap removed in accordance with an embodiment of this invention.

In FIG. 3, cap 16 has been removed from assembly 10. Insert 24 is disposed within the annular interior of neck 14 of vessel 11. Band 18 of neck 14 is disposed within groove 28 of insert 24 so that insert 24 cannot easily be pulled out of, or removed from, vessel 11. Dispenser 34 is disposed within the interior of insert 24. An outer portion of upward facing shoulder surface 38 of band 37 contacts and is engaged with downward facing shoulder surface 26 of insert 24 so that dispenser 34 cannot easily be raised and pulled out of insert 24. Base 35 of dispenser 34 contacts and is engaged with seal 30 in insert 24 to form a fluid tight seal. Hole 32 in seal 30 closes when deformed to prevent cosmetics from leaking out around base 35 of dispenser 34 when the cosmetics are exiting hole 32 and flowing into dispenser tube 42.

When in the open position, cosmetics can flow from vessel 11, out of hole 32, through dispensing tube 42, out of opening 46, and into applicator 43. In one embodiment, cosmetic flow to applicator 43 can be aided and enhanced if the user applies pressure to vessel 11. Vessel 11 is preferably formed of a flexible and resilient material such as polypropylene, so that it may be easily squeezed by the user and is capable of returning to its original shape.

Figure 4:
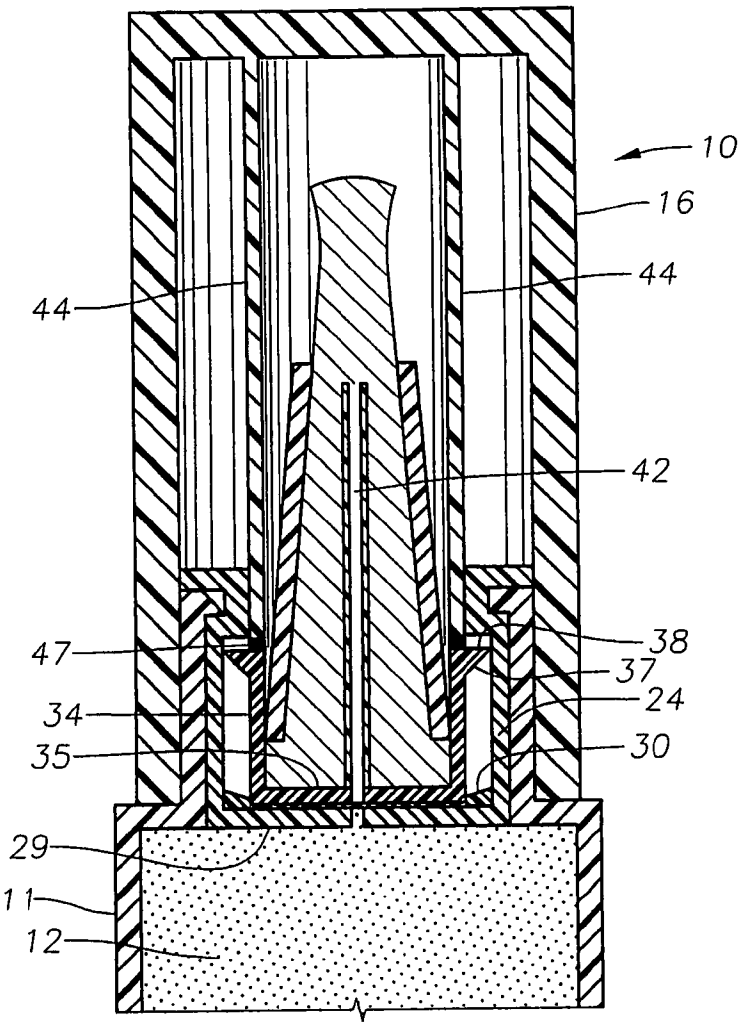
FIG. 4 is a front cross-section view of the assembly with its cap affixed thereon in accordance with an embodiment of this invention.

As illustrated in FIG. 4, when assembly 10 is not in use, cap 16 will typically be placed over applicator 43 to protect applicator 43 from dust and other contaminants. As cap 16 is being lowered and approaches full engagement with vessel 11, the bottom end of engagement member 44 contacts an exposed portion of upward facing shoulder 38 on band or flange 37 of dispenser 34. Member 44 pushes down and places pressure upon band 37 and forces dispenser 34 downward into increased engagement with seal 30 in insert 24. As a result of the increased force, seal 30 in insert 24 will compress and stretch downward. Preferably, the pressure placed upon seal 30 by the increased force will result in about 0.5 mm of stretching. This stretching causes the sides of hole 32 in seal 30 to come together, and hole 32 will close substantially or completely shut. As a result, the flow of cosmetics from vessel 11 into dispensing tube 42 is prevented. Further, base 35 of dispenser 34 engages seal 30 of insert 24 in one or more locations to a significant degree and forms a fluid tight seal that further blocks any small flow of cosmetic from vessel 11 from leaking from assembly 10.

Figure 2:
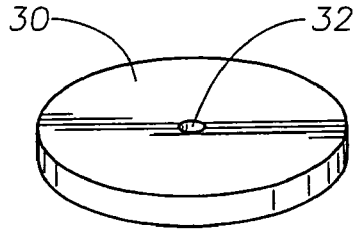
FIG. 2 is a perspective view of the cylindrical base of an insert in accordance with an embodiment of this invention.
Figure 5:
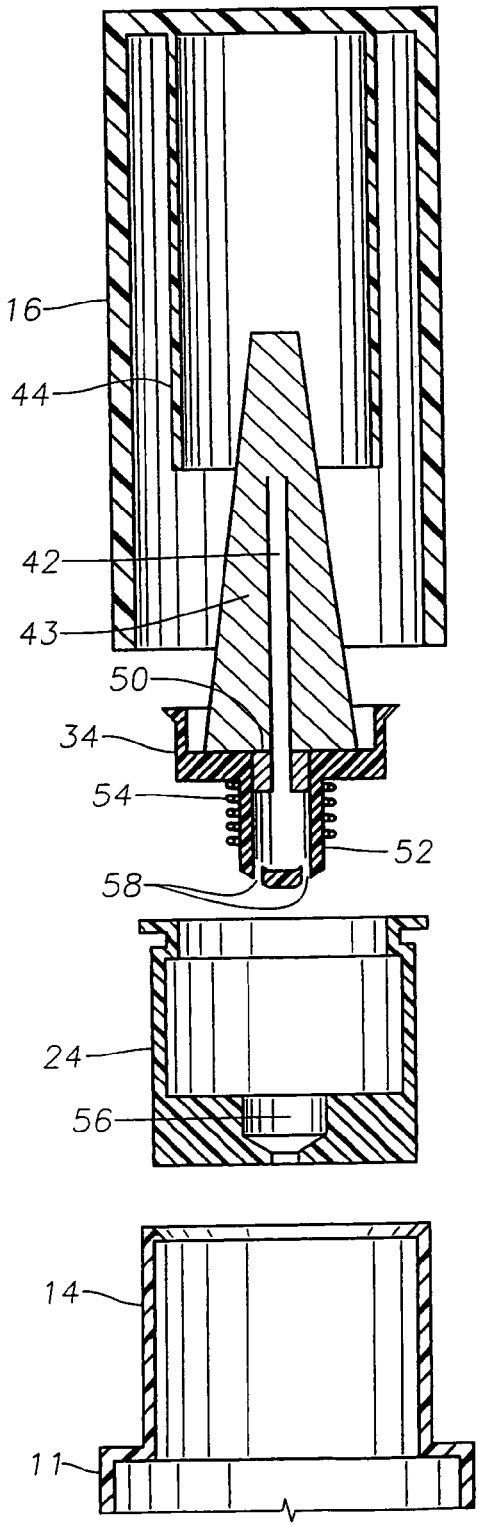
FIG. 5 is a front cross-section view of the assembly with a spring surrounding an extension of the assembly dispenser in accordance with an embodiment of this invention.
Figure 6:
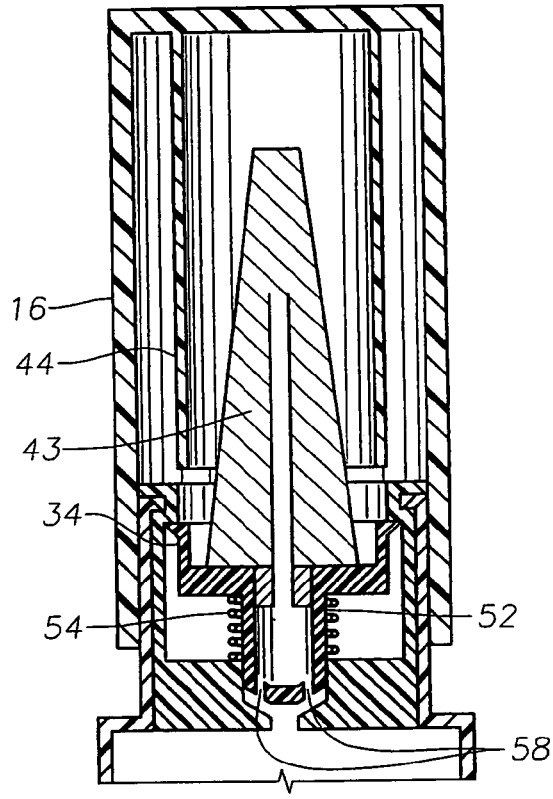
FIG. 6 is a front cross-section view of the alternative embodiment of FIG. 5 with its cap removed.
Figure 7:
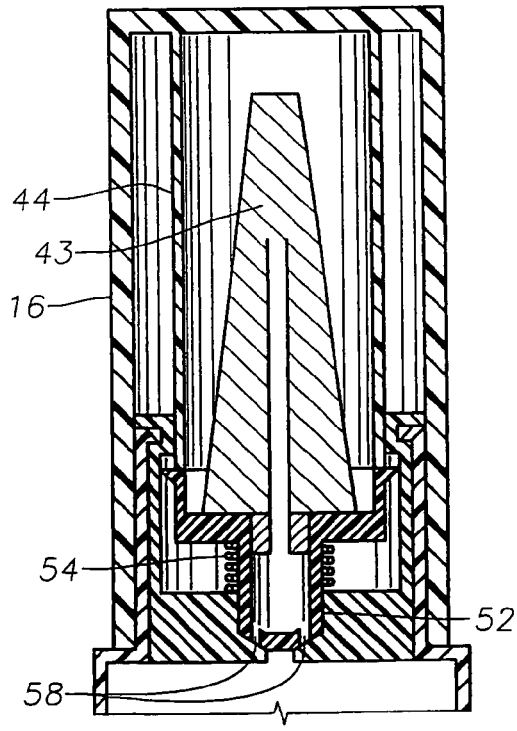
FIG. 7 is a front cross-section view of the alternative embodiment of FIG. 5 with its cap affixed thereon.
Figure 8:
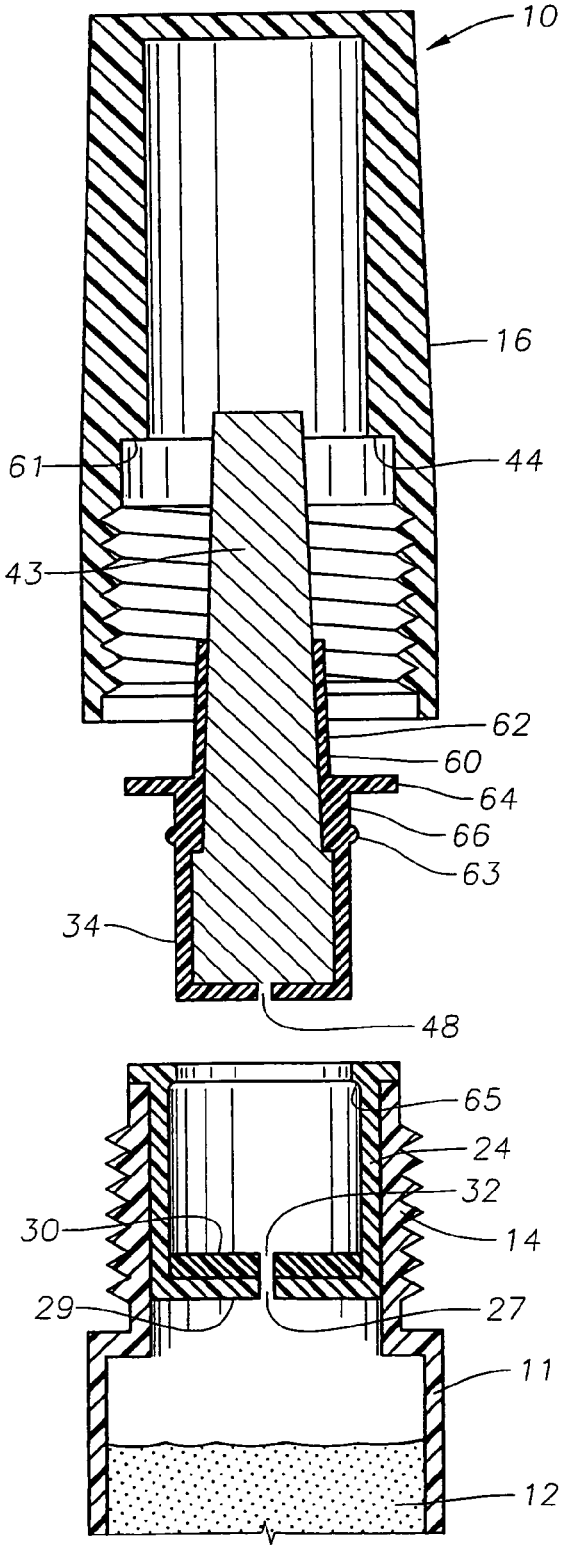
FIG. 8 is a front cross-section view of the components of a fluid applicator assembly with a case partially surrounding the applicator in accordance with an embodiment of this invention.
Figure 9:
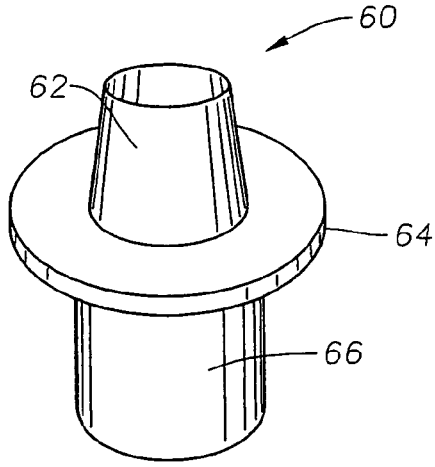
FIG. 9 is a perspective view of an applicator case according to an embodiment of this invention.

An alternative embodiment of the present invention is shown in FIGS. 5-7. Dispenser 34 has an extension 52 that extends downward therefrom. The extension 52 fits within a cavity 56 formed within the base of insert 24. Preferably, the extension 52 has two holes 58 formed therewithin to allow cosmetic to flow from the neck 14 of the vessel 11 through the holes 58 into the interior of the extension 52, and then into the tube 42. In an embodiment, a stopper 50 surrounds the lower portion of the tube 42 to prevent leakage. A spring 54 surrounds some or all of the extension 52. A sheath or case, such as sheath 45 of FIG. 2, optionally could surround a portion of applicator 43. When the cap 16 is closed, as shown in FIG. 7, engagement member 44 forces dispenser 34 downward, the spring 54 is compressed and the two holes 58 are brought into engagement with the surface of insert 24 and sealed closed so that cosmetic does not pass through. When the cap 16 is opened, as shown in FIG. 6, the spring 54 expands and the dispenser 34 moves upward, which opens the two holes 58 and allows fluid to pass through into the interior of the extension 52. The spring 54 may be disposed within the cavity 56 or alternatively, the spring 54 may be wider than the diameter of the cavity 56 and brace against the bottom floor of the insert 24 without entering the cavity 56. Other locations for the spring 54 are possible without departing from the scope of the invention.

Other embodiments of the assembly 10 of the present invention are also advantageously provided, as illustrated in FIGS. 8-13. In one embodiment, engagement member 44 comprises a downward facing shoulder formed in the annular interior wall of cap 16 rather than a separate cylinder as in FIGS. 1-7. Member 44 faces downward within the interior of cap 16. Although cap 16 is thicker than in FIGS. 1-7, this embodiment advantageously allows for a larger interior volume within the cap covering the applicator 43. A friction reducing element 47 as shown in FIG. 1, for example padding, may be formed on member 44.

In an embodiment of the present invention, applicator 43 does not contain a dispensing tube 42. As a result, cosmetics enter the porous applicator 43 via aperture 48, which results in increased flow of cosmetics throughout the interior of applicator 43.

In certain embodiments, a case 60 which is similar to case or sheath 45 of FIGS. 1-7, is integrally formed with dispenser 34. Preferably, case 60 sits within dispenser 34 and can be mounted thereto or matingly engaged therewith. Case 60, which can be more clearly seen in FIG. 9, has a generally tubular shape and a hollow interior. Case 60 is preferably formed of a plastic material. A flange or platform 64 is matingly engaged with case 60 or alternatively, is formed therewith. Platform 64 preferably surrounds the case 60 and separates the case 60 into a first portion 62 and a second portion 66. The platform 64 is preferably disk-shaped and serves as a shoulder for engagement by engagement member 44. The first portion 62 of the case 60 preferably surrounds a bottom portion of applicator 43, for example, to hold the applicator 43 securely in place. In a preferred embodiment, the first portion 62 is narrower along its top section to hold applicator 43 in place. The second portion 66 of case 60 is preferably mounted or affixed to dispenser 34.

Figure 10:
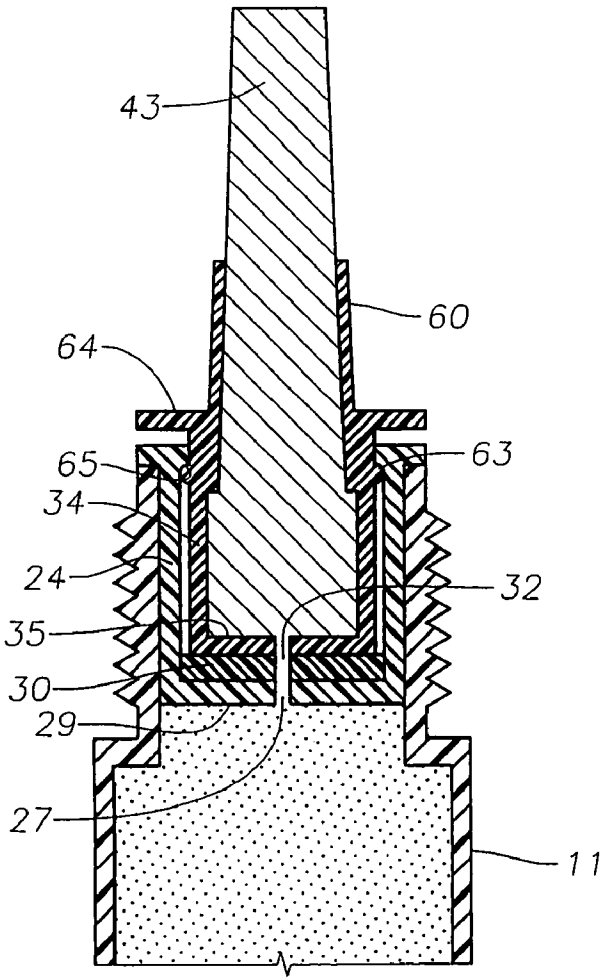
FIG. 10 is a front cross-section view of an assembly with the applicator partially disposed within a case and the cap removed according to an embodiment of the invention.

A rib 63 is integrally formed on the exterior of dispenser 34 in the embodiments of FIGS. 8-11. Rib 63 is below flange 64 and slidingly engages the interior of insert 34. Rib 63 contacts a downward facing retaining shoulder 65 formed in insert 24 while dispenser 34 is in a upper open position, as shown in FIG. 10. While in the closed position of FIG. 11, rib 63 is spaced below retaining shoulder 65.

Figure 11:
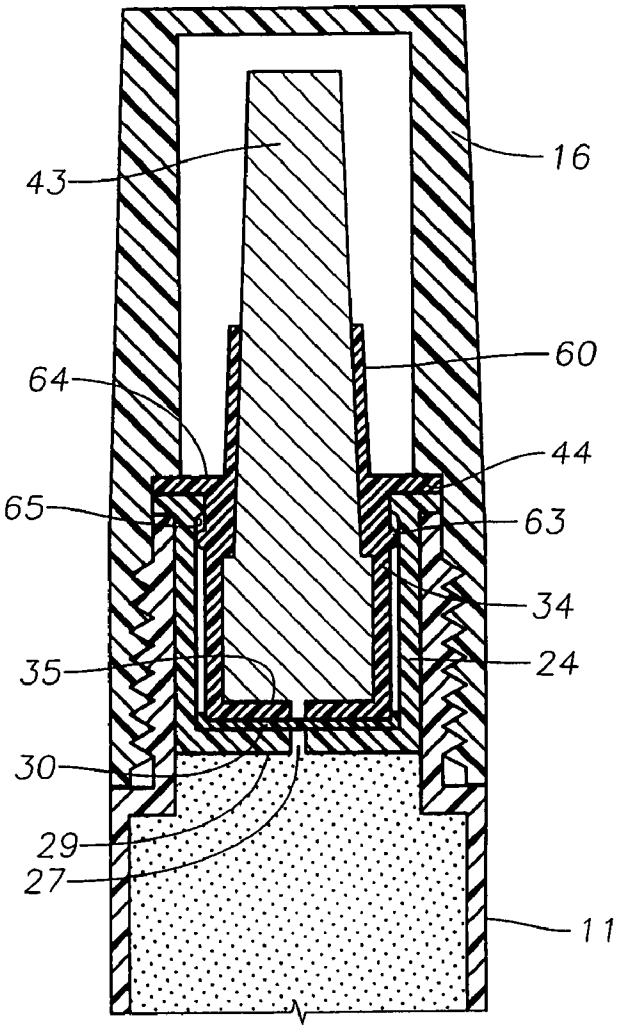
FIG. 11 is a front cross-section view of an assembly with the applicator partially disposed within a case and the cap affixed thereto according to an embodiment of the invention.

As shown in FIGS. 10 and 11, when cap 16 is lowered and comes into full engagement with vessel 11, engagement member 44 contacts an exposed portion of platform 64. Member 44 pushes down and places pressure upon platform 64 and forces case 60 downward. As a result, dispenser 34 is also forced downward inside of insert 24 and into increased engagement with seal 30 of insert 24. As a result of the increased force, seal 30 of insert 24 will compress and stretch downward. Preferably, the pressure placed upon seal 30 by the increased force will result in about 0.5 mm of stretching. This stretching causes the sides of hole 32 in seal 30 to come together, and hole 32 will close substantially or completely shut. As a result, the flow of cosmetics from vessel 11 into applicator 43 is prevented or substantially reduced. Further, base 35 of dispenser 34 engages seal 30 of insert 24 in one or more locations to a significant degree and forms a fluid tight seal that further blocks any small flow of cosmetic from vessel 11 from leaking from assembly 10.

Figure 13:
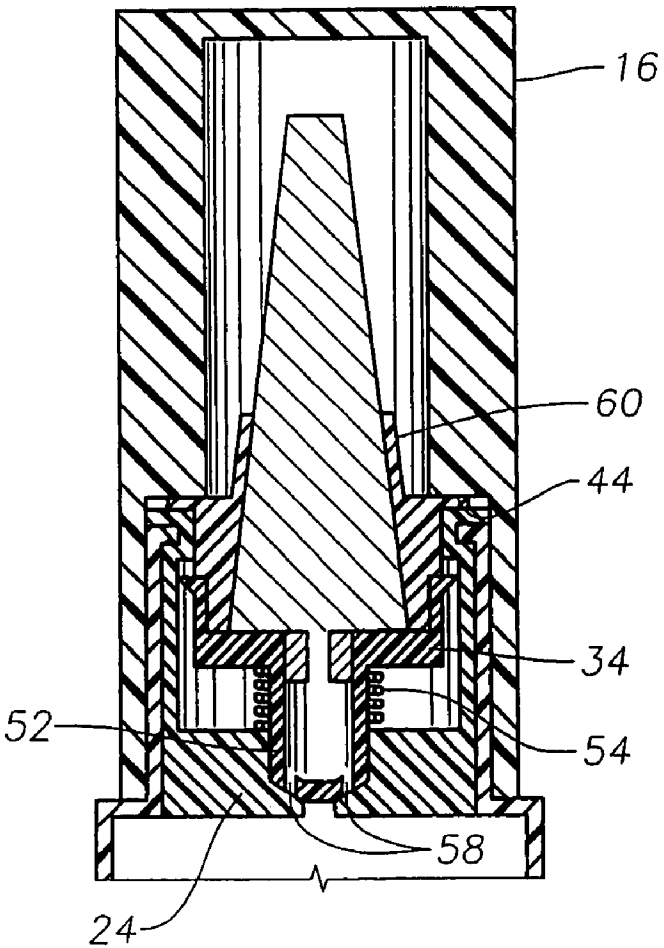
FIG. 13 is a front cross-section view of the embodiment of FIG. 12 with the cap affixed thereto in accordance with an embodiment of this invention.
Figure 12:
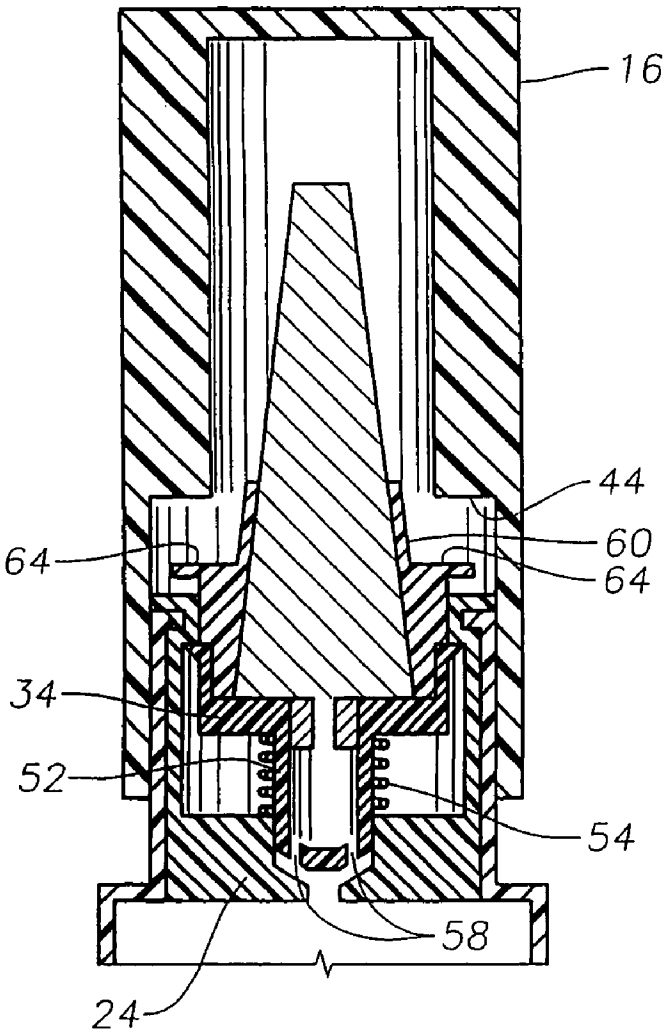
FIG. 12 is a front cross-section view of the assembly with a case partially surrounding the applicator and a spring surrounding an extension of the applicator dispenser and the cap removed in accordance with an embodiment of this invention.

In the embodiment illustrated in FIGS. 12 and 13, spring 54 surrounds some or all of extension 52. When cap 16 is closed, the engagement member 44 contacts an exposed portion of platform 64 surrounding case 60. Member 44 pushes down and places pressure upon platform 64 and forces case 60 downward. As a result, dispenser 34 is also forced downward, spring 54 is compressed and the two holes 58 in extension 52 are brought into engagement with the surface of insert 24 and sealed closed so that cosmetic does not pass through. When the cap 16 is opened, the spring 54 expands and the dispenser 34 moves upward, which opens the two holes 58 and allows fluid to pass through into the interior of the extension 52.

Figure 14:
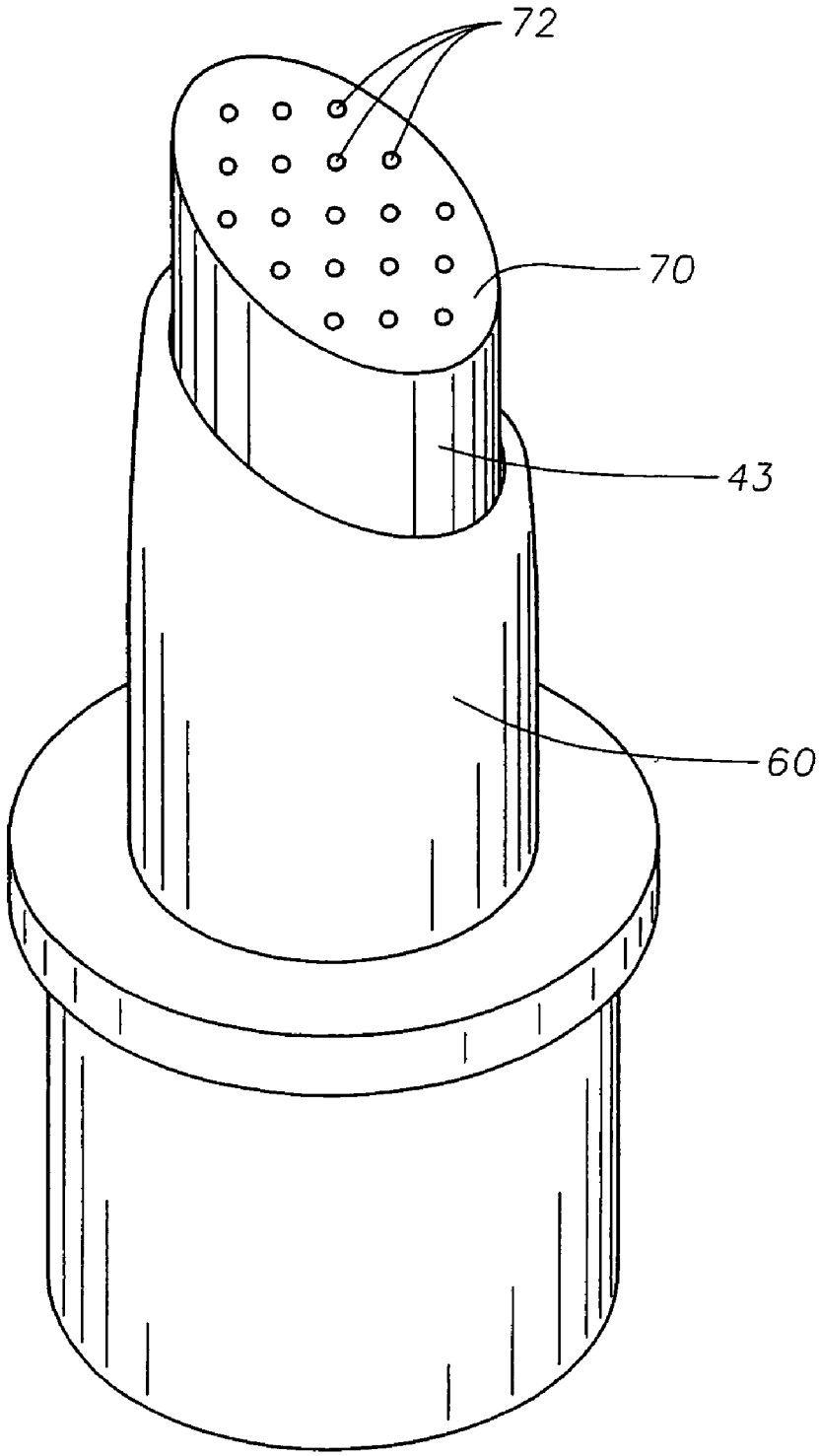
FIG. 14 is a perspective view of a case having an applicator with a tapered upper surface disposed therein in accordance with an embodiment of this invention.

Another embodiment of the applicator 43 of the present invention is advantageously provided, as shown in FIG. 14. In this embodiment, the applicator 43 is cylindrically shaped and has a tapered upper surface 70. The surface 70 can also be flat. The applicator 43 is at least partially surrounded by case 60, and an upper portion of the applicator 43 adjacent to the upper surface 70 is exposed. A plurality of orifices 72 are formed in the upper surface 70 of the applicator 43. Cosmetics material exits the applicator 43 through one or more of the orifices 72. The plurality of orifices 72 allows for increased dispersion of the cosmetics exiting the applicator 43, and also decreases the likelihood of reduced or impeded cosmetics flow occurring due to clogging and the like. Applicator 43 could be used in place of applicator 43 of the other embodiments of this invention.

The present invention has several advantages. For example, the insert 24 and dispenser 34 are prevented from being easily pulled out of or removed from the vessel 11. With the cap 16 is fully engaged with the vessel 11, the closed hole 32 in the seal 30 of the insert 24 and the seal against the base 35 of the dispenser 34 together prevent or significantly reduce the amount of fluid leakage from the assembly 10. When the cap 16 is removed from the vessel 11, the seal between the base of the insert 24 and the base of the dispenser 34 significantly reduces the amount of fluid leakage from the assembly 10.

While the invention has been described herein with respect to certain embodiments, it should be understood by those that are skilled in the art that it is not so limited. The invention is susceptible of various modifications and changes without departing from the scope of the claims.

The invention claimed is:

1. A fluid dispenser assembly, the assembly comprising:

a container body having a reservoir for storing a fluid material, the body having a dispensing opening;

a supporting base in the dispensing opening, the supporting base having a passage leading to the reservoir;

a pad of an elastic material located on the base, the pad being in the shape of a disk having an aperture therethrough that is in alignment with the passage in the base, the pad having a radial dimension extending from an edge of the aperture to the outer diameter of the pad that is greater than a diameter of the aperture;

a dispenser having a lower portion within the dispensing opening in engagement with the pad, the dispenser being movable relative to the base between an open position wherein the aperture in the pad is open and a closed position deforming the pad against the base and squeezing the aperture in the pad closed;

an applicator mounted to the dispenser protruding from the dispensing opening for receiving fluid material from the container and applying the fluid material when the dispenser is in the open position; and a cap releasably secured to the container body, wherein the cap contacts the dispenser and moves the dispenser to the closed position when the cap is secured to the container.

2. The assembly of claim 1, wherein the pad is formed of a silicone material.

3. The assembly of claim 1, wherein the elastic material of the pad pushes the dispenser to the open position when the cap is removed from the container body.

4. A fluid dispenser assembly, the assembly comprising:

a container body having a reservoir for storing a fluid material, the body having a dispensing opening;

a generally cup-shaped insert having a hollow interior and a passage in fluid communication with the reservoir, the insert being stationarily secured with the dispensing opening of the container;

a pad of flexible material located in the insert, the pad being in the shape of a flat disk with upper and lower sides and a constant thickness, the pad having an aperture formed within a center of the pad, the aperture having a constant diameter from the lower to the upper side of the pad, the pad having a radial dimension extending from an edge of the aperture to the outer diameter of the pad that is greater than a diameter of the aperture;

a dispenser having an applicator mounted thereto; the dispenser being at least partially disposed within the hollow interior of the insert and moveable with respect to the insert from an open position in which the aperture in the pad is open to allow fluid material to flow from the reservoir through the passage and the aperture into the dispenser and a closed position in which the dispenser deforms the pad and squeezes the aperture closed; and a removable cap releasably secured to the container body, the cap engaging the dispenser to move the dispenser to the closed position when the cap is secured to the container body.

5. The assembly of claim 4, whereby the container has a neck that contains the dispenser opening.

6. The assembly of claim 4, wherein:

the insert has a downward facing surface within its hollow interior; and the dispenser has a rib on its exterior that is within the hollow interior of the insert below the downward facing surface, the rib being in sliding engagement with the hollow interior of the insert.

7. The assembly according to claim 4, wherein:

the pad is located on a base of the insert;

the passage extends through the base in alignment with the aperture in the pad; and each of the upper and lower sides of the pad extends in a single plane from an outer diameter of the pad to the aperture.

8. The assembly of claim 7, wherein:

the insert has cylindrical sidewalls extending upward from the base; and a radial dimension of the base extending from an edge of the passage to the cylindrical sidewall of the base is greater than a diameter of the passage.

9. The assembly of claim 4, wherein:

the dispenser has a flat bottom and cylindrical sidewall extending upward therefrom; and the pad sealingly engages the flat bottom of the dispenser while the dispenser is in the open position and in the closed position.

10. The assembly of claim 9, wherein a radial dimension of the flat bottom extending from an edge of the aperture to the cylindrical sidewall of the flat bottom is greater than a diameter of the passage.

11. The assembly of claim 9, wherein:

the insert has cylindrical sidewalls extending upward from the base; and while in the open position, the dispenser maintains sufficient pressure on the pad to cause it to seal against the base to prevent leakage of fluid material between the cylindrical sidewall of the dispenser and the cylindrical sidewall of the insert.

12. A fluid dispenser assembly, the assembly comprising:

a container body for storing a fluid material, the body having a dispensing opening and a neck that contains the dispensing opening;

an insert having a base and a cylindrical sidewall within the opening in the neck, the base having a flat upper side and a passage formed therein;

a pad of a resilient material located on the upper side of the base, the pad being in the shape of a disk having flat upper and lower sides and a constant thickness, the pad having an aperture aligned with the passage in the base, the aperture having a constant diameter from the lower to the upper side of the pad each side of the pad extending in a single plane from an outer diameter of the pad to the aperture, the lower side of the pad overlying the upper side of the base;

a dispenser having an applicator mounted thereto, the dispenser having a flat bottom and a cylindrical sidewall extending upward therefrom, the dispenser being at least partially disposed within the cylindrical sidewall of the insert, the dispenser being moveable with respect to the insert from an upper position in which the aperture in the pad is open to allow fluid material to flow through the passage and the aperture into the dispenser and applicator, and a lower position in which the bottom of the dispenser deforms the pad and squeezes the aperture closed to block flow of the fluid material into the dispenser;

while in the upper position, the dispenser maintaining sufficient pressure on the pad to cause it to seal against the base to prevent leakage of fluid material between the cylindrical sidewall of the dispenser and the cylindrical sidewall of the insert; and a removable cap that encloses the applicator and releasably secures to the container body, the cap engaging the dispenser to move the dispenser to the lower position when the cap is secured to the container body.

13. The assembly of claim 12, wherein the pad is formed of a silicone material.

* * * * *